United States Patent [19]

Mitchell

[11] Patent Number: 4,683,901

[45] Date of Patent: Aug. 4, 1987

[54] COVER FOR FLOATING BOAT DOCK

[76] Inventor: Robert W. Mitchell, 1622 Newberry Ave., Columbia, S.C. 29210

[21] Appl. No.: 816,367

[22] Filed: Jan. 6, 1986

[51] Int. Cl.[4] ..... E04H 15/18; E04H 15/34; B63B 17/00

[52] U.S. Cl. ..... 135/97; 135/101; 135/905; 114/263; 114/361

[58] Field of Search ..... 135/101, 97, 115, 117, 135/119, 905, 90; 114/263, 258, 361

[56] References Cited

U.S. PATENT DOCUMENTS

| | | | |
|---|---|---|---|
| 447,097 | 2/1891 | Zoller et al. | 114/361 X |
| 1,204,329 | 11/1916 | Wilkins | 135/106 |
| 1,377,788 | 5/1921 | Pennewell | 135/117 |
| 1,643,464 | 9/1927 | McCullers | 114/263 |
| 1,962,457 | 6/1934 | Noble et al. | 135/111 |
| 2,144,747 | 1/1939 | Adams | 135/106 |
| 2,293,329 | 8/1942 | Coburn | 135/90 |
| 2,516,869 | 8/1950 | Harris | 135/119 X |
| 2,757,677 | 8/1956 | Denn | 135/106 |
| 2,887,975 | 5/1959 | Smith | 114/263 |
| 2,897,831 | 8/1959 | Liden | 135/106 |
| 2,912,703 | 11/1959 | Murphy | 135/90 |
| 2,922,653 | 1/1960 | O'Brien | 135/101 |
| 2,984,076 | 5/1961 | Bradley | 405/219 |
| 3,114,377 | 12/1963 | Clement | 135/106 |
| 3,424,178 | 1/1969 | Yazaki | 135/DIG. 9 |
| 3,441,037 | 4/1969 | Transeau | 135/97 X |
| 3,698,409 | 10/1972 | Koontz et al. | 135/115 X |
| 4,066,089 | 1/1978 | Rainwater | 135/117 X |

*Primary Examiner*—Robert A. Hafer
*Assistant Examiner*—D. Neal Muir
*Attorney, Agent, or Firm*—Benoni O. Reynolds

[57] ABSTRACT

An apparatus which utilizes precut, coated fiber canvases, vertical and horizontal support elements, multiple rotatable couplings and detachable shoe-like receptacles, together with lacing rope and other miscellaneous hardware, to provide a shelter for a boat secured in a floating dock. The modular structure and unique design of the apparatus permits it to be easily and quickly erected or dismantled, on site, using only a set of Allen Wrenches. Each of the partially preassembled vertical support elements is unfolded and reenforced on the site with a lateral support member and a pair of angular truss members. Multiple numbers of these vertical support elements are then interconnected by three precut horizontal truss members and two precut horizontal roof support members to produce whatever length of dock cover is required. Finally, the top canvas, the two side canvases and the front and rear canvases are lashed to the front and rear roof members, respectively, and to the two side horizontal members, with lacing rope, using a unique pattern of lacing.

5 Claims, 8 Drawing Figures

COVER FOR FLOATING BOAT DOCK

BACKGROUND OF THE INVENTION

1. Field of Invention

The present invention relates to apparatus for sheltering docked boats and is especially suited as a shelter for a boat docked in a floating dock.

2. Description of the Prior Art

The sheltering of boats presents many problems not encountered in conventional structures. Boat houses can be very expensive due to the terrain encountered along the shoreline. Also, it is desirable to have access to the shelter by driving the boat in under the shelter or running the boat up on a cradle, which in turn can be drawn into the shelter on tracks. Likewise, some decking or planking is needed around the inside perimeter of the dock for loading and unloading passengers, as well as for working on the boat.

One of the most economical solutions is the use of a floating boat dock which need only be tied to the shoreline. But the covering of such docks poses problems not encountered in land based shelters and fixed docks. Rising and falling tides, winds and turbulent water make rigid structures impractical in covering floating docks. There must be some built-in resiliency to avoid stress on the supporting structure. Also, such dock covers must be customized for the length and height of boat to be accommodated. In addition, there must be some provision for dismantling so that the cover can be shipped from place to place.

Only two references were found which dealt directly with floating boat docks, as such. McCullers' Dock (1927) introduced sections which could be bolted together to support a duraluminum roof. He used gears, racks and pawls to permit independent adjustment of either side of his dock. Spaced floats supported the structure when assembled. Unlike the present invention, McCuller's invention was addressed more to the versatility of his height adjustment than to resiliency, ease of assembly and economy.

Bradley's Boat Storage Houses (1961) introduced roof rafters, shaped in an arc, fastened to one another by U-shaped clips having ears pivotally mounted to tongues, which allowed the rafters to give with any lateral stress. The rafters supported a roof of corrugated sheet material. The base of the rafters were also pivotally mounted to the floating platforms on each side, to permit slight rotation of the rafters with lateral movement of the structure. The floats upon which his structure rested were tethered to pilings by large rings which slipped up and down on the pilings, permitting the floats to move up and down with the tides but preventing the dock from swinging left or right or pulling away from the shore. Due to its complexity, this inventor doubts that Bradley's dock can be as easily assembled as claimed in his objectives.

Collapsible structures from other applications have made contributions to the art but none meet the needs of floating boat docks as simply and as economically as does the present invention. The present invention meets its major objective of ease of assembly with a design that simultaneously provides resiliency, ease of assembly and economy, in a manner not found in the floating boat docks of the prior art. Prior art known to this inventor includes the following U.S. Pat. Nos.:

| | | |
|---|---|---|
| 1,643,464 | 9/1927 | McCullers |
| 1,962,457 | 6/1934 | Noble et al |
| 2,144,747 | 1/1939 | Adams |
| 2,293,329 | 8/1942 | Coburn |
| 2,912,703 | 11/1959 | Murphy |
| 2,922,653 | 1/1960 | O'Brien |
| 2,984,076 | 5/1961 | Bradley |
| 3,441,037 | 4/1969 | Transeau |

BRIEF SUMMARY OF THE INVENTION

The present invention is an apparatus for sheltering a boat secured in a floating dock. Because of its light, modular construction and its few, simple components, the apparatus is easily assembled or dismantled using only a set of Allen Wrenches.

According to the preferred embodiment of this invention, a top canvas assembly, to protect the upper portions of the boat, is supported by multiple numbers of partially preassembled vertical support means. Two or more of these vertical support means are interconnected to one another by horizontal support means precut to the length required to cover boats of various sizes. Two side canvas assemblies are provided, for optional use, to protect the lower portions of the boat. A front canvas assembly is provided to protect the front portion of the boat and to permit ready access to the interior of the sheltered area. The top, side and front and rear canvas assemblies are coated fiber canvas disposed over, and laced to, the assembled numbers of vertical support means and the horizontal support means by lacing rope, such as nylon.

The heart of the modular construction is the multiple numbers of vertical support means used to support the top canvas assembly and to provide for ease of assembly of the apparatus. Each vertical support means includes two roof members, two vertical members, a lateral support member and two angular truss members. Prior to delivery on site, the two roof members are joined at their apex by a rotatable coupling. Each of the two vertical members also is joined at its top to the lower end of each of the roof members by a rotatable coupling and secured at its bottom, when assembled, to the deck of the dock by a detachable, shoe-like receptacle. When the vertical support means is fully assembled, the roof members are disposed at less than a 90 degree angle to the horizontal plane, to provide rain runoff for the top canvas which they support. Upon arrival at the site, the two roof members and the two vertical members are extended on the ground in their approximate assembled positions. To provide lateral stability, a lateral support member is then attached between and near the top of the vertical members by a T-coupling. Finally, an angular truss member is slidably attached across each of the two junctures between the lateral support member and each of the vertical members, to provide further lateral stability.

After two or more of the vertical support means have been assembled, as described above, and placed in parallel arrangement, the rotatable couplings of each vertical support means is interconnected with the corresponding rotatable couplings of its neighboring vertical support means by three precut horizontal truss members. Further, to support the top canvas and to provide additional horizontal stability, two or more precut horizontal roof support members are attached by a fixed coupling to each of the roof members, thus interconnecting the roof members of multiple numbers of the vertical support means, as required by the length of the dock desired.

Finally, two precut side horizontal members are attached, by four way couplings, to the vertical members of the assembled numbers of vertical support means, at a midpoint of each vertical support means, to provide further horizontal stability and to provide lashing posts for lacing the top canvas and the two side canvases to the sides of the supporting structure.

OBJECTIVES OF THE INVENTION

The objectives of the present invention are to provide a cool, attractive, protective cover for a floating boat dock, which cover is:

(1) more simple and inexpensive to manufacture than devices known in the prior art designed to perform a similar function;

(2) constructed with resilient components, to compensate for shifting centers of gravity and to withstand the stresses of tides, turbulent water and wind gusts;

(3) modular in design with a minimum number of components, for ease of erection and dismantling on site by two novices with no special tools except a set of Allen Wrenches;

(4) customized in construction, so that modular units can be added or withheld in advance, and support elements precut prior to site, for boats of various heights or lengths; p (5) capable of being laced with all canvases for lengthy storage of a boat or with just the top canvas for ease of access to a moored boat;

(6) capable of being installed in an offset position with relation to the floating boat dock, to provide inside access on one side of a moored boat and an outside walkway adjacent the opposite side of the moored boat;

(7) equipped with rollable front and back canvases having quick detachable straps, to provide easy access to the front and rear portions of a moored boat.

Other objectives and advantages will be apparent during the course of the following detailed description.

DETAILED DESCRIPTION OF THE PREFERRED EMBODIMENT OF THE INVENTION

Figure 1:
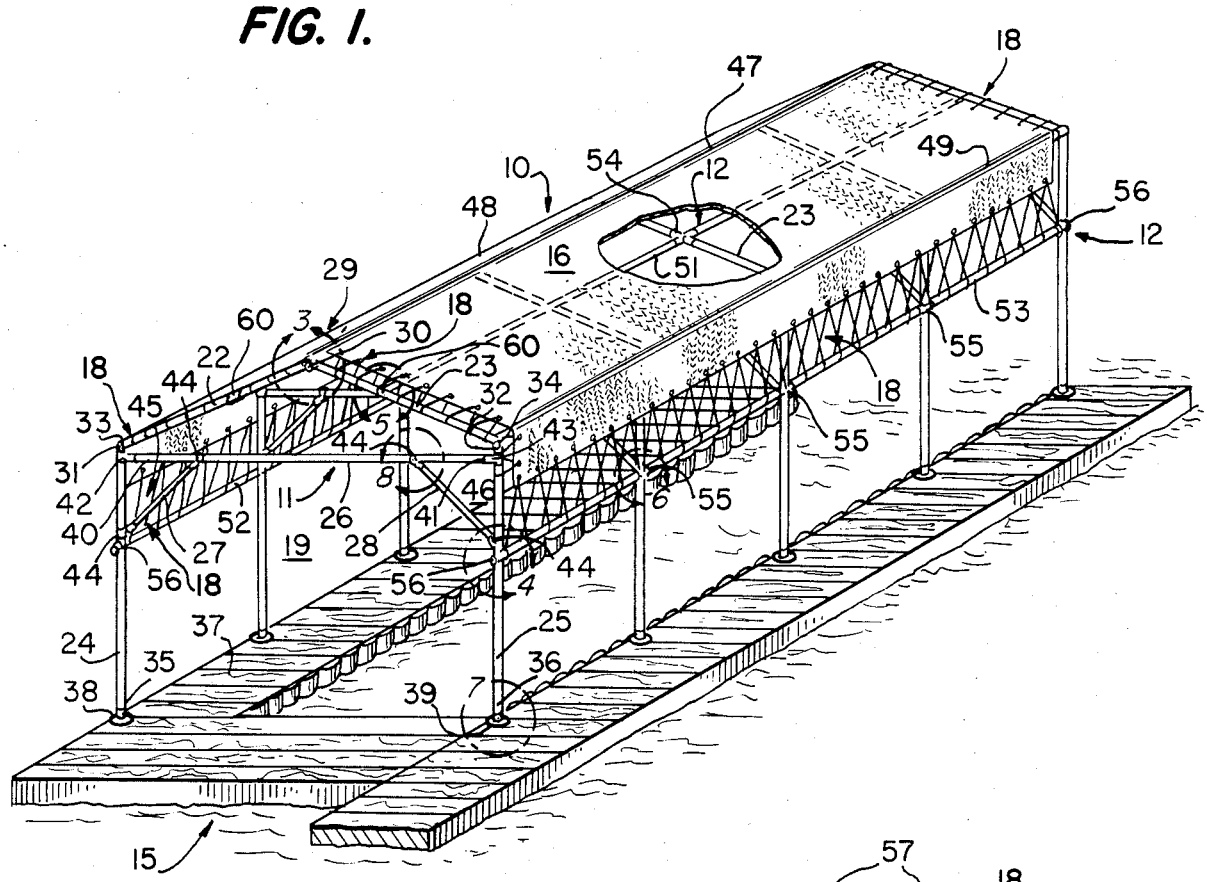
FIG. 1 is a perspective view, from the right front, of an optional mode of the cover for a floating dock, constructed in accordance with the principles of the present invention, showing only the top canvas and its lacing pattern, as well as the offset position of the apparatus in relation to the deck of the floating boat dock.

The present invention is an apparatus for sheltering a boat secured in a floating dock. The apparatus is easily and quickly erected or dismantled on a selected floating dock by two people using only a set of Allen Wrenches as their tools. Throughout the following detailed description of the present invention, like reference numerals are used to denote like parts disclosed in the accompanying drawings, FIGS. 1–8.

Figure 2:
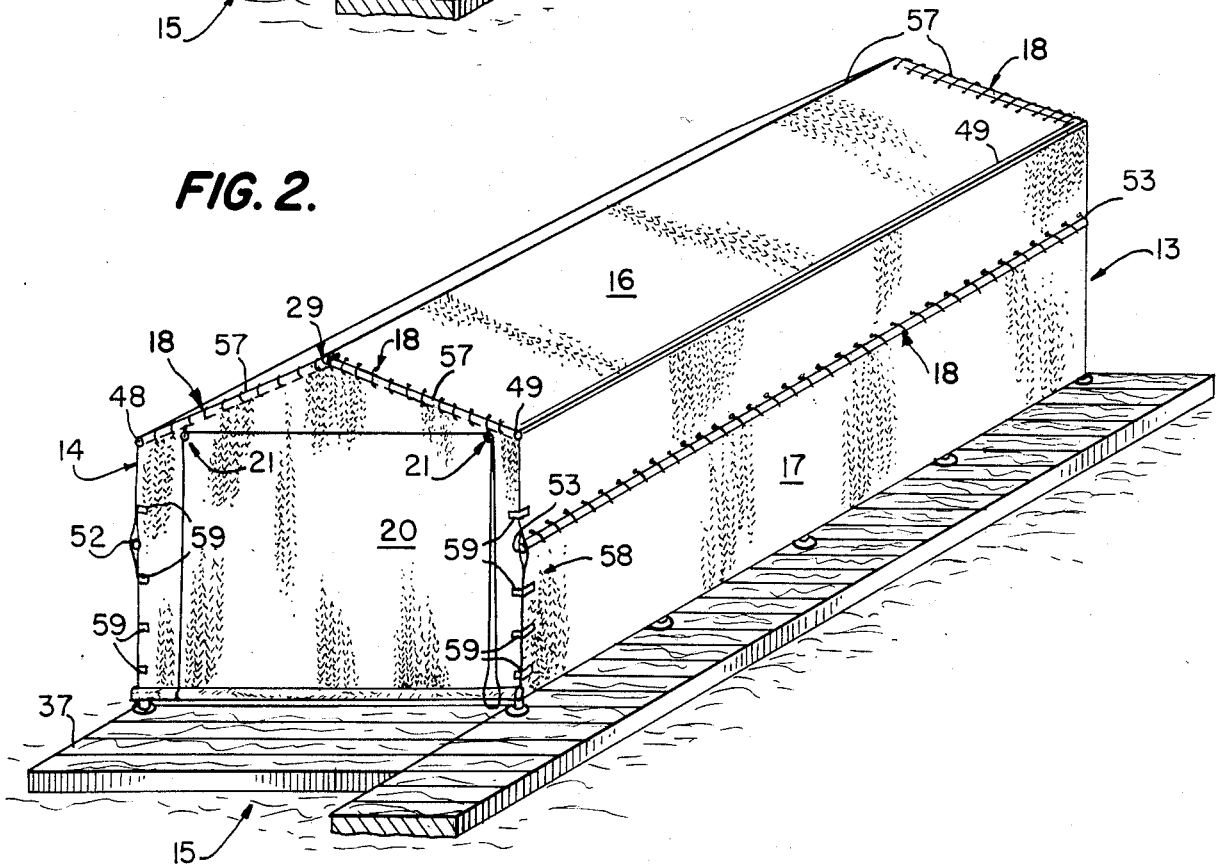
FIG. 2 is a view of the present invention, similar to the view of FIG. 1, showing all of the canvases fully installed.
Figure 3:
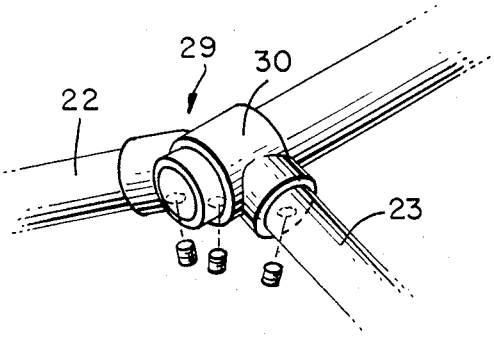
FIG. 3 is a detailed view of the rotatable coupling used to join each pair of roof members at their apex and to join each roof member to its adjoining vertical member.
Figure 6:
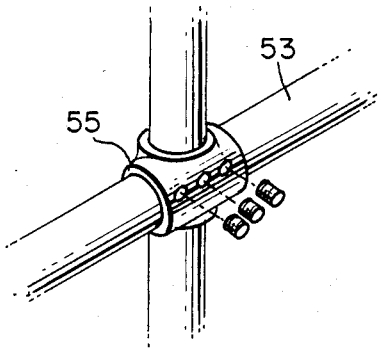
FIG. 6 is a detailed view of the four way coupling used to join each side horizontal member to the adjacent inside vertical members.
Figure 4:
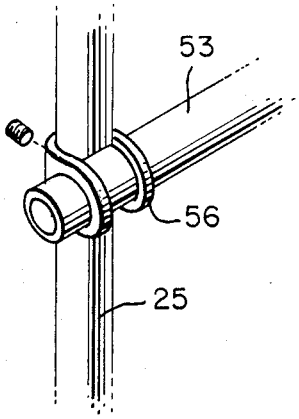
FIG. 4 is a detailed view of the U-coupling used to join the side horizontal members to the vertical members of the front and rear vertical support means.
Figure 7:
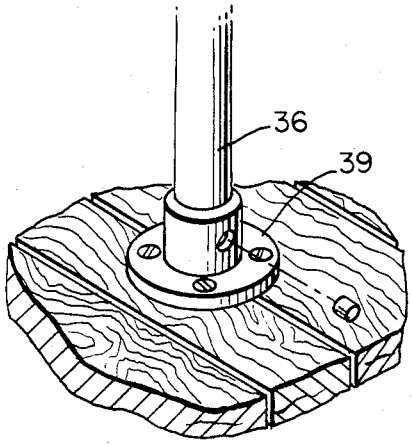
FIG. 7 is a detailed view of the detachable shoe which is attached to the deck of the floating boat dock and supports the bottom of each vertical member in an upright position.
Figure 5:
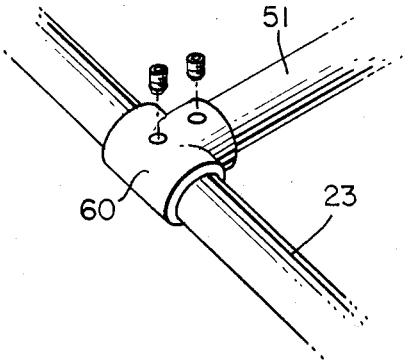
FIG. 5 is a detailed view of the T-coupling used to join each lateral support member to its adjoining vertical members.
Figure 8:
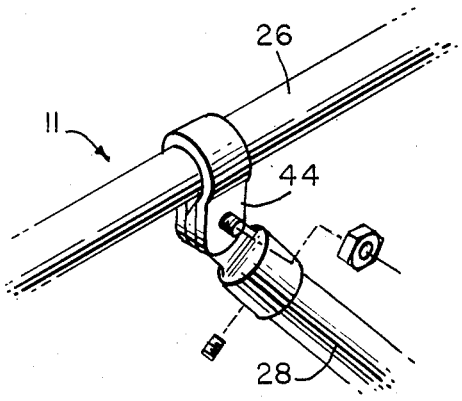
FIG. 8 is a detailed view of the collar coupling used to attach the vertical truss members across the junctures between each lateral support member and its adjoining vertical members.

As shown in FIGS. 1 and 2, the cover for a floating dock is designed so that its components can be assembled in two modes. An optional mode is shown in FIG. 1, where only top canvas assembly, shown generally at reference numeral 10, is disposed over vertical support means, shown generally at reference numeral 11, and over horizontal support means, shown generally at reference numeral 12. In the fully enclosed mode of the present invention, shown in FIG. 2, the supporting means are covered, in addition to top canvas assembly 10, with side canvas assemblies, shown generally at reference numeral 13, and with front and rear canvas assemblies, shown generally at reference numeral 14. The side canvas assembly on the left side of the apparatus is identical with side canvas assembly 13, shown on the right side of the apparatus, and thus is not separately shown in the drawings. Similarly, the rear canvas assembly is identical with front canvas assembly 14 and is likewise not shown in the drawings.

Top canvas assembly 10 protects the upper portions of any boat (none shown) secured in the floating dock, shown generally at reference numeral 15. Top canvas assembly 10 is a coated fiber canvas 16 disposed over vertical support means 11 and horizontal support means 12. As shown in FIGS. 1 and 2, the two side canvas assemblies 13 protect the lower portions of any boat secured in floating dock 15. Each of the side canvas assemblies 13 is a coated fiber canvas, such as shown at reference numeral 17, disposed over each side of a multiple numbers of vertical support means 11 and lashed to front and rear vertical support means 11 and to horizontal support means 12 by lacing rope, shown generally at reference numeral 18. Front and rear canvas assemblies 14 protect the front and rear portions of the boat (none shown), respectively, and provide ready access to the interior of the sheltered area, shown generally at reference numeral 19. Front and rear canvas assemblies 14 are each a coated fiber canvas, such as shown at reference numeral 20, disposed over the front and rear vertical support means 11, respectively, and lashed thereto, in such a manner that coated fiber canvas 20 can be rolled upward by rope and pulley assembly, such as shown generally at reference numeral 21, for access to the interior of shelter area 19. The coated fiber canvas used for all of the canvas assemblies of the present invention are preferably canvases which are 18 ounces in weight, such as Bonde Cote 302-18, manufactured by Fiber Industries, Inc.

The present invention, as shown in FIGS. 1 and 2, uses multiple numbers of vertical support means 11 (depending on the length of cover desired) to support top canvas assembly 10 and to provide for ease of assembly of the apparatus. Vertical support means 11 is two roof members 22 and 23, two vertical members 24 and 25, a lateral support member 26 and two angular truss members 27 and 28. Roof members 22 and 23 are joined at their apex, shown generally at reference numeral 29, by a rotatable coupling 30 (detailed in FIG. 3) and disposed at less than 90 degrees to the horizontal plane of the apparatus to provide runoff for any rain striking top canvas 16. Each of the two vertical members 24 and 25 is joined at its top 31 and 32, respectively, to the lower ends of roof members 22 and 23, respectively, by rotatable couplings 33 and 34 (detailed in FIG. 3) and secured at its bottom 35 and 36, respectively, to deck 37 of floating dock 15 by detachable shoes 38 and 39, respectively (detailed in FIG. 7). Lateral support member 26 is attached at its ends 40 and 41, respectively, to vertical members 24 and 25, respectively, by T-couplings 42 and 43, respectively (detailed in FIG. 5). Each of the two angular truss members 27 and 28 is attached by collar clamps 44 (detailed in FIG. 8) across Junctures 45 and 46, respectively, between lateral support member 26 and vertical members 24 and 25, respectively.

Horizontal support means 12 joins and supports two or more of vertical support means 11, as may be required to cover boats of various lengths. Horizontal support means 12 is three horizontal truss members, 47, 48 and 49, two or more horizontal roof support members, such as shown at reference numeral 51, and two side horizontal members 52 and 53. The left horizontal roof support member is not shown but it is identical with the right horizontal roof support member shown at reference numeral 51. Horizontal truss members 47, 48 and 49 interconnect the corresponding rotatable couplings 30, 33 and 34 of each of the roof members 22 and 23 and of vertical members 24 and 25 of multiple numbers of vertical support means 11, to provide horizontal stability to the apparatus. The two or more horizontal roof support members 51 are attached by T-couplings 60 (detailed in FIG. 5) or by four way couplings 54 (such as detailed in FIG. 6) to each of roof members 22 and 23 of multiple numbers of vertical support means 11, as required by the length of floating dock 15 desired. As shown in FIG. 1, the two side horizontal members 52 and 53 are attached by four way couplings 55 (detailed in FIG. 6) and by U-couplings 56 (detailed in FIG. 4) to vertical members 24 and 25, respectively at a mid-point of these vertical members, to provide horizontal stability to the apparatus and to provide lashing posts, as shown in FIGS. 1 and 2, for lacing top canvas 16 and side canvases 17 to side horizontal members 52 and 53, respectively. Side horizontal member 52, on the left side of the apparatus, is identical to side horizontal member 53 on the right side of the apparatus.

As further shown in FIGS. 1, coated fiber canvas 16, of top canvas assembly 10, is precut and disposed over precut roof members 22 and 23, interconnected by precut horizontal truss members 47, 48 and 49 and by precut horizontal roof support members 51, and lashed to roof members 22 and 23 of the front and rear vertical support means 11 and to precut side horizontal members 52 and 53 by lacing rope 18.

Coated fiber canvases 17, of side canvas assemblies 13, are precut and disposed over precut vertical members 24 and 25 and precut side horizontal members 52 and 53 and lashed to vertical members 24 and 25 of the front and rear vertical means 11 and to side horizontal members 52 and 53 by lacing rope 18.

Each of the coated fiber canvases 20, of front and rear canvas assemblies 14, which are identical, is precut and is disposed over, and completely covers, front and rear support means 11, respectively, and is lashed at its top 57 to precut roof members 22 and 23 of front and rear vertical support means 11, respectively, in such a manner that each of coated fiber canvases 20 can easily be rolled upward, by rope and pulley assembly 21, for access to the interior of sheltered area 19. Strap means, shown generally at reference numeral 58, is disposed along the edges of coated fiber canvases 20 to affix these canvases to the sides of top canvas assembly 10 and to side canvas assemblies 13, when access to sheltered area 19 is not required. Strap means is a series of straps 59, such as Velcro hooks and loops, which detachably affix the edges of front and rear canvas assemblies 14 to top canvas assembly 10 and to side canvas assemblies 13.

To assure tautness in the rigging of canvases 16, 17 and 20, a unique pattern of lacing should be followed. Top canvas 16 is laced on the supporting means first. Then one of the side canvases 17 and back canvas 20 should be laced on secondly. Thirdly, the remaining side canvas 17 is laced on. Finally, front canvas 20 is laced on and lacing rope 18 drawn tight to stretch canvases 16, 17, and 20 and to prevent them from flying in the wind. Any other lacing pattern permits the canvases to flap in the wind and they would eventually loosen up with no way of easily tightening them. If these canvases stretch, it is easy to tightened them all by merely tightening lacing rope 18.

I claim:

1. Apparatus for sheltering a boat secured in a floating dock, comprising a top canvas assembly to protect the upper portions of said boat, and two side canvas assemblies to protect the lower portions of said boat, and front and rear canvas assemblies to protect the front and rear portions of said boat, respectively, and to provide ready access to the interior of the sheltered area, and multiple numbers of vertical support means, to support said top canvas assembly and to provide for ease of assembly of said apparatus, comprising two roof members, joined at their apex by a rotatable coupling and disposed at less than a 90 degree angle to the horizontal plane, and two vertical members, each joined at its top to the lower end of one of the said roof members by a rotatable coupling and secured at its bottom to the deck of said dock by a detachable shoe, and a lateral support member each end of which is attached to one of said vertical members by a T-coupling, and two angular truss members, each of which is attached by collar clamps across the junctures between said lateral support member and each said vertical member, and horizontal support means, to join and support two or more of said vertical support means as required to cover boats of various lengths, comprising three horizontal truss members which interconnect the corresponding rotatable couplings of each of said roof members and said vertical members of the multiple numbers of said vertical support means, to provide horizontal stability to said apparatus, and two or more horizontal roof support members, attached by T-couplings and four way couplings to said roof members, to interconnect said roof members of multiple numbers of said vertical support means, as required by the length of the dock desired, and two side horizontal members attached by four-way couplings and by U-couplings to said vertical members of multiple numbers of said vertical support means at a mid point of said vertical members to provide horizontal stability to said apparatus and to provide lashing posts for lacing said top canvas and said side canvases to said side horizontal members.

2. The apparatus of claim 1 wherein said top canvas assembly is a precut coated fiber canvas disposed over precut roof members, interconnected by precut horizontal truss members and by precut horizontal roof support members, and lashed to the roof members of the front and rear vertical support means and to precut side horizontal members by lacing rope.

3. The apparatus of claim 1 wherein said side canvas assemblies are precut coated fiber canvases disposed over precut vertical members and precut side horizontal members and lashed to said vertical members of the front and rear vertical support means and to said side horizontal members by lacing rope.

4. The apparatus of claim 1 wherein each of said front and rear canvas assemblies is a precut coated fiber canvas disposed over, and completely covering, the front and rear vertical support means of said apparatus, respectively, which coated fiber canvas is lashed at its top to the precut roof members of said front and rear vertical support means, respectively, in such a manner that said coated fiber canvas can easily be rolled upward for access to the interior of said sheltered area, and strap means disposed along the edges of said coated fiber canvas to affix said canvas to the sides of said top canvas assembly and to said side canvas assemblies when access to the sheltered area is not required.

5. The apparatus of claim 4 wherein said strap means is a series of straps which detachably affix the edges of said front and rear canvas assemblies to said top canvas assembly and to said side canvas assemblies.

* * * * *